US005947279A

United States Patent [19]

Lee et al.

[11] Patent Number: 5,947,279

[45] Date of Patent: Sep. 7, 1999

[54] STORAGE SYSTEM

[75] Inventors: Fei Chen Lee, Tapei, Taiwan; Alex Hofstetter, Cranston, R.I.

[73] Assignee: Beautone Specialities Co., Ltd., Marlborough, Mass.

[21] Appl. No.: 09/026,577

[22] Filed: Feb. 20, 1998

[51] Int. Cl.[6] ..... B65D 30/20

[52] U.S. Cl. ..... 206/232; 206/308.1; 206/425; 229/67.4

[58] Field of Search ..... 206/232, 308.1, 206/308.3, 387.13, 311, 312, 425, 805; 229/67.3, 67.4; 383/40

[56] References Cited

U.S. PATENT DOCUMENTS

| | | | |
|---|---|---|---|
| 554,574 | 2/1896 | Bennett | 206/425 |
| 3,312,384 | 4/1967 | Heynamann | 229/67.4 |
| 4,202,585 | 5/1980 | Lawler . | |
| 4,730,727 | 3/1988 | Petroff . | |
| 4,778,051 | 10/1988 | Schaub et al. | 206/387.13 |
| 5,064,069 | 11/1991 | Su | 206/425 |
| 5,193,681 | 3/1993 | Lievsay . | |
| 5,271,502 | 12/1993 | Chang | 206/425 |
| 5,275,438 | 1/1994 | Struhl . | |
| 5,288,144 | 2/1994 | Guderyon | 206/232 |
| 5,544,745 | 8/1996 | Famorca | 383/40 |
| 5,579,908 | 12/1996 | Johnson . | |
| 5,593,086 | 1/1997 | Ho | 229/67.4 |
| 5,630,509 | 5/1997 | Su | 206/425 |
| 5,664,724 | 9/1997 | Ho | 229/67.4 |

*Primary Examiner*—Paul T. Sewell
*Assistant Examiner*—Luan K. Bui
*Attorney, Agent, or Firm*—Ernest V. Linek; Banner & Witcoff, Ltd.

[57] ABSTRACT

A portable filing and storage system having a unitary cover subdivided into a front flap, a top, a back, a bottom and a front; the cover being constructed and arranged to provide an open-sided surrounding enclosure. A media holder is mounted to the front portion of said cover, and an accordion file is mounted to the interior of the enclosure defined by said cover. The file system has a closed configuration wherein the front flap is in overlying relationship with said front portion of the cover, and an open configuration where the front flap is elevated from the front portion of said closure. A closure retainer for maintaining the file system in the closed configuration is provided.

6 Claims, 4 Drawing Sheets

STORAGE SYSTEM

BACKGROUND OF THE INVENTION

1. Field of the Invention

The present invention relates generally to storage and organization of documents and computer storage media, and more particularly to a compact storage and/or filing case having divided, compartmentalized document storage space and one or more 3.5" floppy disk slots.

2. Background

Many attempts have been made in the prior art for providing an organizer for documents and computer media either separately or in combination. As will be recognized, none of the prior art solutions offer a flexible protective compartmentalized apparatus for both documents and computer storage media, convenient use and ease of identification of and access to contents, and economical manufacture.

U.S. Pat. No. 4,664,258 discloses a diskette holder of the type which may be received in albums or table stands. The holder comprises a plurality of relatively stiff sheets to form a pocket for a floppy disk in the form of a sandwich-type structure. The pocket is then subsequently removable mounted in storage unit, such as a binder or box. This approach does not allow the facile storage of the computer-readable media with paper documents, such as directory listings, file printouts or hard copies, documentation, and the like.

U.S. Pat. No. 4,957,205 describes another computer disk holder attachable to a three ring notebook. The holder is essentially a rigid plastic frame page with plastic detents for holding the disks on the frame page. While this arrangement allows the filing of documents in the three ring binder with the computer readable storage media, the three ring binder format is far from ideal. The snap rings of the binder are often difficult to manipulate. The hard copies to be stored must be perforated with holes in a certain alignment, and if the documents are thick, such as software documentation booklets, perforation may require them to be disassembled before punching. Further, if the items stored are of differing sizes, the overall organization of the binder is substantially hindered.

U.S. Pat. No. 5,275,438 discloses a file folder with an attached computer disc pocket. The pocket includes a rear wall, a front wall, a cover flap and a retaining flap to prevent the loss of a disc contained therein. The walls of the file and the pocket may be made from translucent plastic to allow easy view of the file folder contents.

U.S. Pat. No. 5,394,981 discloses a box-type storage unit for computer diskettes and provides space for documentation. The box has a latched cover and contains loose-leaf plastic pages for holding the computer-readable storage media and the documentation. One major disadvantage of this system are that the box-type construction renders the case more suitable for archival purposes, e.g., for placement on a shelf, than for portability. The plastic pages limit the amount of storage available, and their pre-sized format makes the inclusion of many documents of varying size difficult to order according to the needs of the user: that is, the predominantly limiting sorting criterion is by size.

U.S. Pat. No. 4,730,727 discloses an accordion-type holder for diskettes having a cover. Disadvantageously, there is no provision for an easy way to include various sized documents with the floppies. A further disadvantage is the requirement for the use of adhesive labels on the exterior of the holder.

U.S. Pat. No. 5,193,681 discloses a spiral-bound notebook which can accommodate diskettes and documents. A major disadvantage with this apparatus is that the multipart construction is held together by a comb-type binding device, which in use can become unbound. Without the appropriate apparatus for binding the leaves of the book to the binding spine, it is very difficult to reintroduce the individual tines of the comb into the slots cut on the leaves should they separate.

U.S. Pat. No. 5,579,908 discloses a retaining envelope for computer discs that consists of a pocket sized to receive the disc and a mounting means for securing the pocket to any desired flat surface.

U.S. Pat. No. 5,193,681 discloses a fastenable book-like holder, organizer and storage device for a series of computer diskettes. A set of diskette envelopes leaved together with pliant covers bound by a device such as a popular plastic comb binding, and fastened by a device such as a hook and loop fastener so that the holder secures a set of computer floppy diskettes. The cover configuration includes an elongated flapped member which can be scored for easy folding around the end of the holder; which, upon closure, secures the contents, and the curve of which, when open, keeps contained diskettes from falling from the various leaves.

U.S. Pat. No. 4,202,585 discloses a modular storage container for flexible recording disks is made up of a plurality of lightweight, flat rectangular panels which are interconnected to form a corresponding number of storage compartments. The outside panels have handle grips to facilitate handling or transporting of the containers, and each storage compartment contains an actuating lever mechanism which through selective depression of an associated push rod having a tab located externally of the compartment, will cause a selected disk to be advanced from its storage location for removal and use. A series of tabs alternate in such a fashion as to allow the rods to be close together without touching one another; yet each tab may be depressed individually without interference from the other tabs.

U.S. Design Pat. No. 332,005 discloses a CD holder, comprising a plurality of plastic pages with CD-receiving sleeves attached to an outer wrapper for securing the pages. This arrangement does not provide for the inclusion of various documentation. If indeed documentation were included, it would likely be a standard-sized CD jewel box insert, which could share an individual envelope with the CD. This arrangement also suffers from the drawback of the lack of any means for interchangeably including a label on the outer surface to identify the contents.

It therefore remains desirable to arrive at improved apparatus for containing and organizing documents and computer readable storage media.

SUMMARY OF THE INVENTION

The present invention provides a flexible, protective portfolio-type organizer filing and storage system which provides for the compact storage of computer readable media, for example 3.5" floppy diskettes, and an accordion-type divided filing region for documents or other related material. The portfolio further provides the added benefit of facile and interchangeable label placement on the outer surface thereof for quick identification of the contents of the filing system at a glance.

According to the invention, a portable filing system is provided having a unitary cover subdivided into a front flap, a top, a back, a bottom and a front; the cover being constructed and arranged to provide an open-sided surrounding enclosure. A media holder is mounted to the front portion of said cover, and an accordion file is mounted to the interior of the enclosure defined by said cover. The file system has a closed configuration wherein the front flap is in overlying relationship with said front portion of the cover, and an open configuration where the front flap is elevated from the front portion of said closure. A closure retainer for maintaining the file system in the closed configuration is provided.

The instant invention allows for facile storage of computer-readable media with paper documents, such as directory listings, file printouts or hard copies, documentation, and the like. Advantageously, the instant invention is a self-contained unit in portfolio form, and therefore does not rely on difficult-to-manipulate snap rings of conventional binders. The hard copies to be stored may be stored in their natural state, and are not required to be perforated with holes in a certain alignment, slid into an envelope, or the like. Further, if the items stored are of differing sizes, the overall organization of the binder is not affected.

Another advantage of this system is that the portfolio-type construction renders the case more suitable for portability, while maintaining the convenient height dimension of a conventional binder for filing on a bookshelf, for example.

A further advantage is that the instant invention provides retainer for interchangeably providing a label on the outer surface to identify the contents. This retainer is conveniently dimensioned in a preferred embodiment to accommodate a half-sheet of standard letter-sized paper, so that custom labels are not required.

Other aspects of the invention are disclosed infra.

BRIEF DESCRIPTION OF THE DRAWINGS

These and other features and advantages of the present invention will become more apparent in view of the following detailed description in conjunction with the accompanying drawing, of which.

DETAILED DESCRIPTION OF THE PREFERRED EMBODIMENT

The present invention will be described herein with reference to the preferred embodiment of a disk file according to the instant invention.

Figure 1:
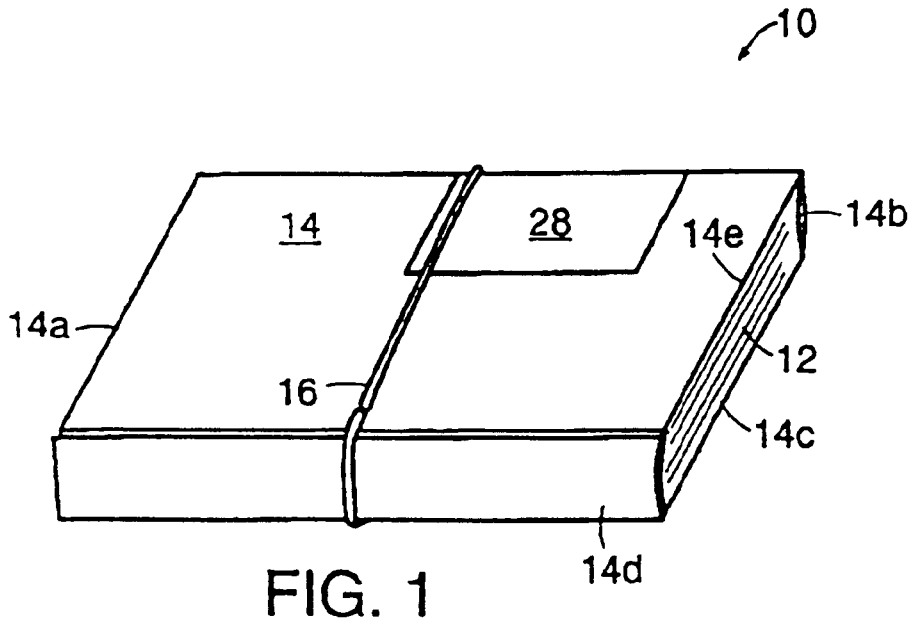
FIG. 1 is a perspective view of the filing system of the instant invention in a first, closed configuration.

Referring to FIG. 1, a disk file system 10 is shown in a first, closed configuration. An accordion file 12 is wrapped in an outer cover 14. In the preferred embodiment, the accordion file is formed of translucent 0.18–0.22 mm gauge plastic to allow viewing of, or ascertaining the presence of, contents. The outer cover 14 is preferably of a relatively tough plastic, rigid enough to provide the desired stability to the system and protection to the contents. In a preferred embodiment the cover 14 is formed of 0.5–0.8 mm gauge polypropylene plastic.

If desired, the accordion file 12 may be omitted, converting the storage and organizing system of this invention into a convenient portfolio. If desired, the accordion file component can be made to be removable and replaceable, as per the needs of the user. Convenient locking materials for such a conversion include Velcro® hook and loop tabs, or other locking and unlocking members useful with lightweight products such as this.

The cover 14 is comprised of a plurality of regions separated by folds or living hinges. These parts can be seen by reference to FIGS. 1 and 2, and include a front flap 14*a*, a top 14*b*, a back 14*c*, a bottom 14*d*, and a front 14*e*. In a closed orientation, the front flap 14*a* of the cover 14 overlies the front 14*e* so as to surround the accordion 12 in an envelope which is open on the sides, as can be seen in FIG. 1. Conveniently, the file system 10 may be maintained in a closed orientation by an elastic band 16 attached to the front flap 14*a*.

Figure 2:
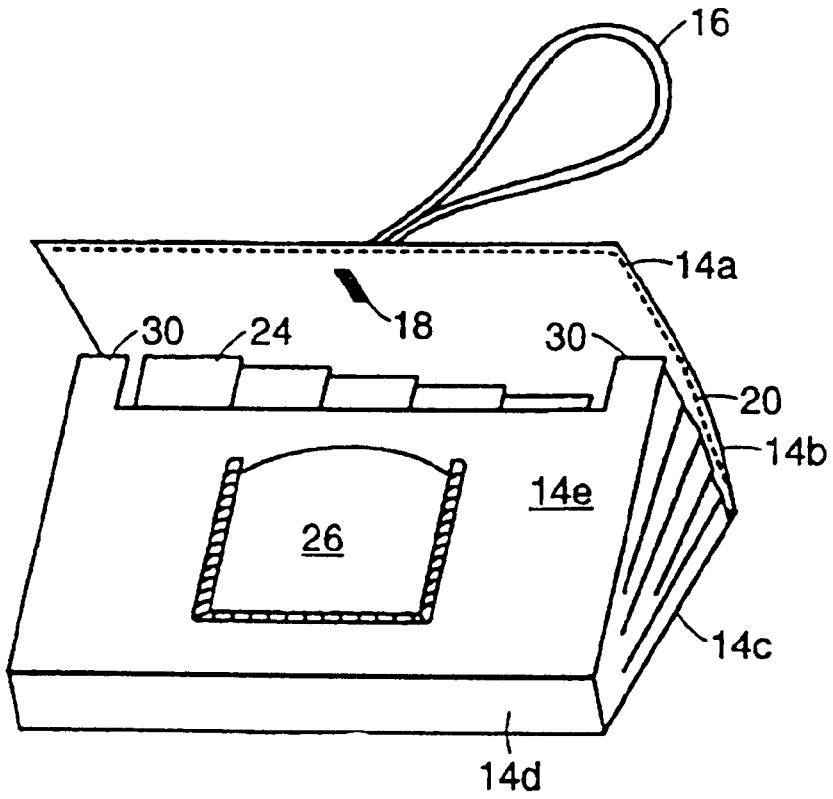
FIG. 2 is a perspective view of the filing system of the instant invention in transition between a first, closed configuration and a second, open configuration.

Turning now to FIG. 2, the file system 10 is shown with the elastic band 16 moved from surrounding engagement with the corners of the file system, and the front flap 14*a* lifted from its engagement with the front 14*e*. As can be seen, the elastic band may be retained on the back of the front flap 14*a* with retainers 18, while the elastic passes through a small hole in the front flap 14*a*. As further may be seen, the accordion 12 is comprised of a Z-fold portion 20, which gives the accordion its expanding and contracting properties. As the front flap 14*a* is lifted, it can be appreciated that the front 14*e* of the cover 14 may have a cutout portion across the top thereof to provide enhanced visibility of divider tabs 24, discussed in further detail below. The cutout results in two tabs 30, which provide for mounting of the Z-fold portion 20 on the back side thereof. Such mounting is accomplished by conventional means, such as adhesive bonding, sonic welding, or heat welding.

Also seen in FIG. 2 is a media holder 26, which may be advantageously dimensioned to hold any machine readable medium. In a preferred embodiment, the holder 26 is dimensioned to receive two or more 3.5" floppy diskettes in side-by-side or overlying relationship.

Figure 3:
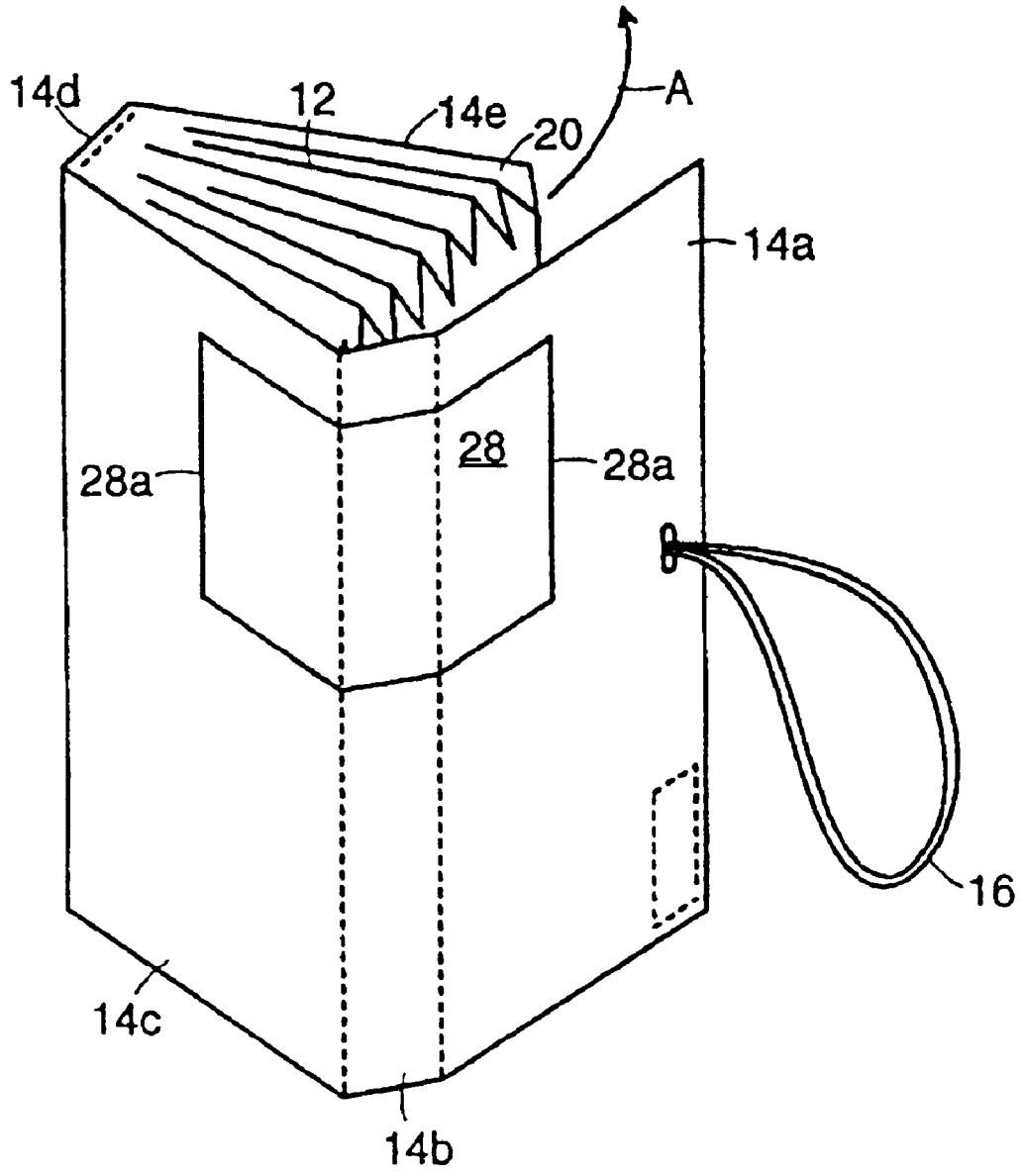
FIG. 3 is a perspective view of the filing system of the instant invention in transition between a first, closed configuration and a second, open configuration from another perspective.

FIG. 3 depicts the filing system of the instant invention being opened from a closed configuration to an open configuration. From this perspective, it can be readily appreciated that the filing system of the instant invention may be dimensioned so as to be conveniently stored on a bookshelf in upstanding, side-by-side relationship, or may be stacked. As can be seen, a label holder 28 may be mounted extending from the front flap 14 a to the back 14*c* across the top 14*b*. When in the closed configuration depicted in FIG. 1, the label holder 28 should be taught. The label holder is mounted to the front flap 14*a* and the back 14*c* at least at the two sides 28*a* thereof. In the preferred embodiment, the label retainer is constructed and arranged so as to define an envelope for a sheet of paper having the dimensions equaling one half of a sheet of letter sized paper. Advantageously, a standard sheet of letter sized paper may be folded into half, e.g. folding a sheet once laterally, to arrive at a folded sheet having the dimensions 8½" by 5½", and then inserted into the holder. This approach dispenses with the need for special labels, sheets that must be cut to size, or other inconvenient arrangements used in the prior art.

Figure 4:
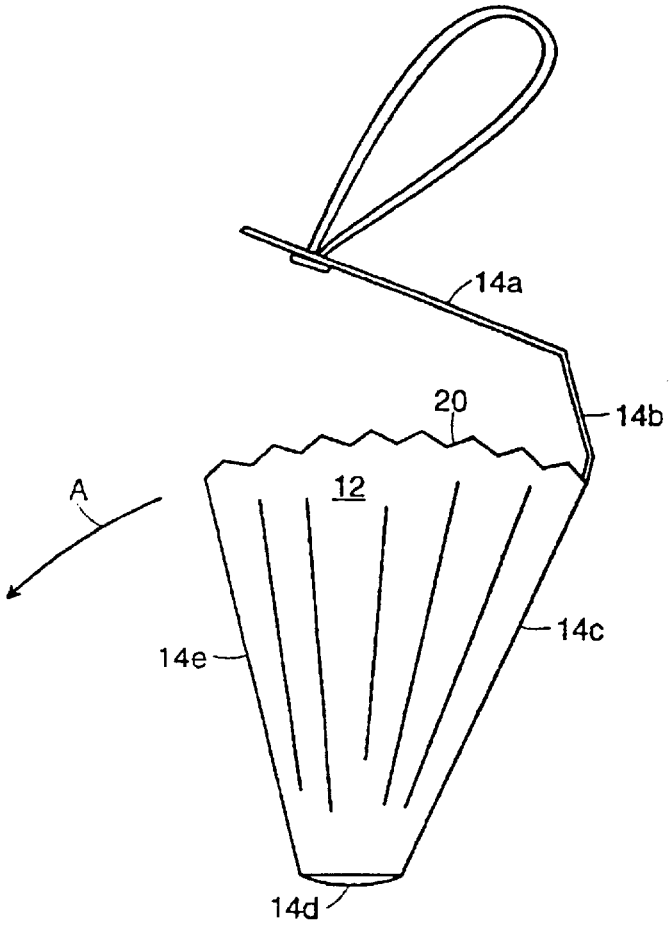
FIG. 4 is a side plan view of the filing system of the instant invention in transition between a first, closed configuration and a second, open configuration.

As further seen in FIG. 3 and by reference to FIG. 4, the Z-fold portion 20 of accordion 12 is mounted to the inside surfaces of front 14*e* and back 14*c*. It can be appreciated that the bottom 14*d* limits the outward expansion of the bottom part of the accordion 12, while the upper portion may easily expand outward in the direction of arrow A. Such expansion provides for facile access to the contents of the file system accordion 12, and also provides for expandability when the file is accommodating contents that are bulky.

Figure 5:
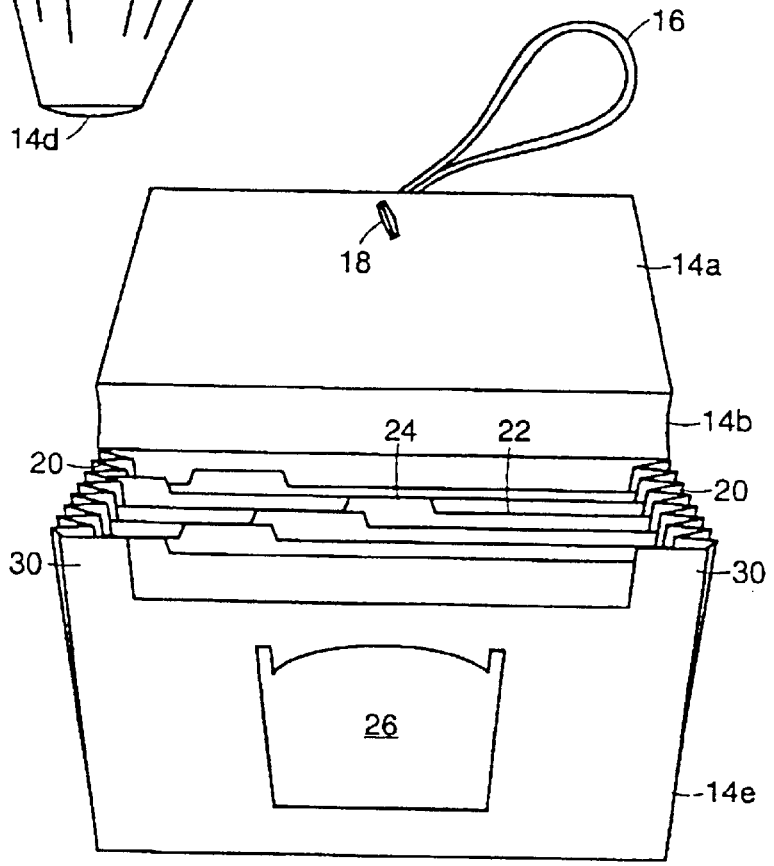
FIG. 5 is a front, perspective view of the filing system of the instant invention in a second, open configuration.

From FIG. 5, it can be seen that spanning the Z-fold portions 20 of the accordion 20 are dividers 22, which may advantageously comprise divider tabs 24. These tabs may be labeled, denoted alphabetically or by other predetermined scheme, or may receive adhesive, pressure-sensitive labels, for example. The cutout of the front 14*e* of the cover 14 between the Z-fold mounting tabs 30 advantageously provides for easy viewing of the divider tabs 24.

Figure 6:
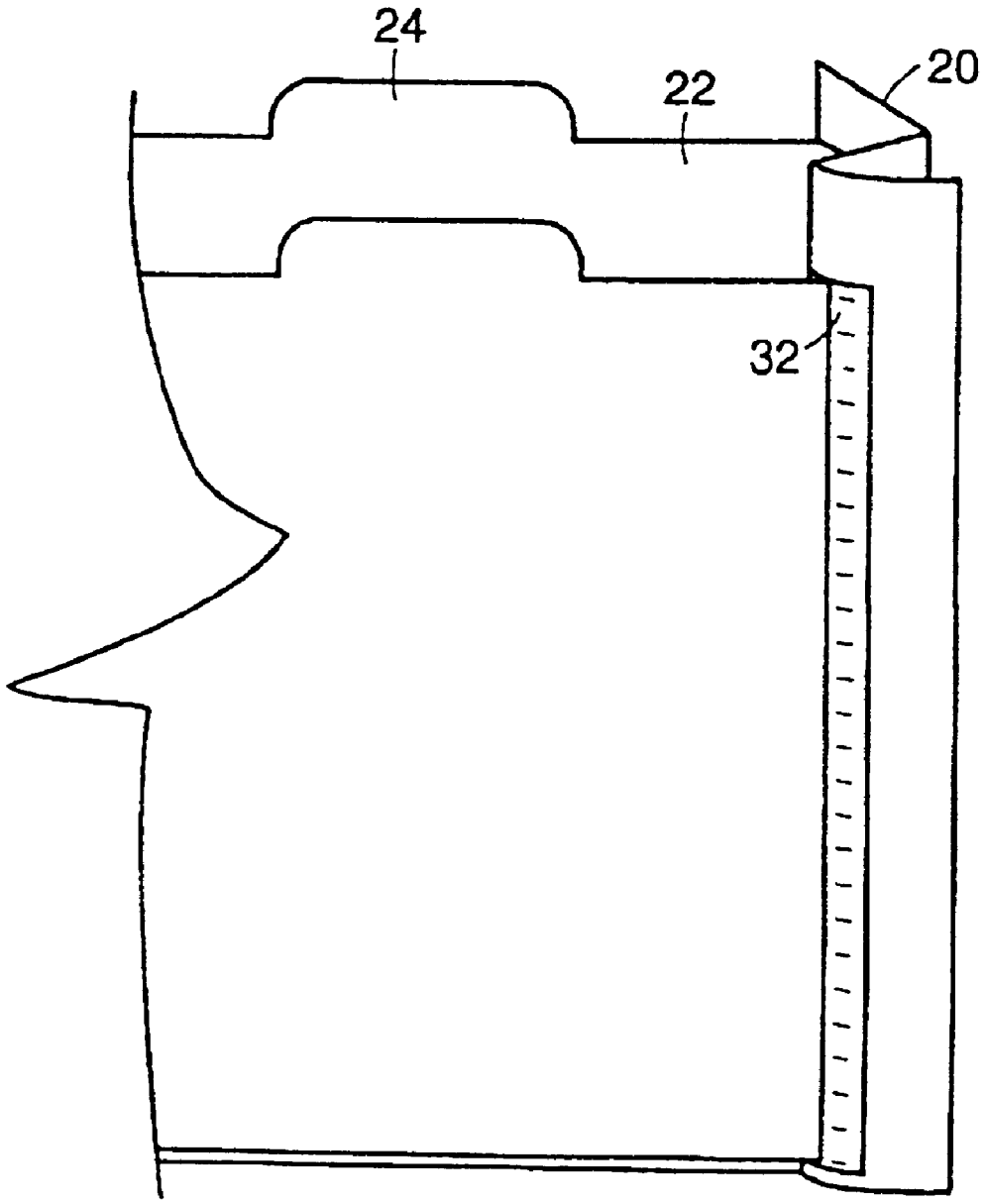
FIG. 6 is a partial view cutaway of an accordion file according to one aspect of the instant invention

Finally, FIG. 6 provides a section view of the accordion 12 depicting a section of the Z-fold portion 20 and a divider 22 attached thereto at an attachment region 32. This attachment may by conventional means, such as adhesive bonding, heat welding, sonic welding, or the like.

In a preferred embodiment, the file system 10 in a basic closed configuration as depicted in FIG. 1 is dimensioned to be about 13" wide, 9⅜" tall and 1⅛" deep. The preferred embodiment comprises two Z-fold members having 27 folds, defining pleats for holding 12 dividers. The dividers in the preferred embodiment are approximately 12½" wide and 8½" tall, not counting the divider tabs, which are approximately ⅝" tall and 1 ¼" wide. The media holder of the preferred embodiment defines two envelopes each having an interior approximately 4⅝" wide and 3" tall, with an open top, such that a 3½" floppy disk is easily accommodated. The preferred embodiment also provides a label holder 8¾" wide by 5½" tall, which after attachment at the margins thereof to the cover along the two lateral sides provides an open-topped and open-bottomed interior envelope accommodating a half sheet of letter-sized paper, viz. 8½" by 5½".

Of course modifications of the preferred embodiment are foreseen. For example, the accordion may be made of other materials, such as polyethylene, polybutylene, other plastics, or cardboard or cardstock or other paperboard. The accordion may also be transparent or opaque, and may be colored in various schemes. The cover also may be made of other materials, including plastics, paper based stocks, cloth or leather, for example. Composite construction, for example using leather or cloth with metal support inserts is also envisioned.

The elastic band 16 may also be fabricated of other materials, such as a cloth tie, nylon webbing, and may further comprise clasps, fasteners, closures or clips well known in the art. Particularly foreseen is the use of hook and loop fasteners, such as Velcro®. Two bands may also be provided, one for each corner of the front flap, instead of one band.

The media holder 26 may of course be flexibly dimensioned to receive other media, such as CD-ROMS, 5.25" floppy diskettes, cassettes, DAT tapes, credit or magnetic swipe cards, flash-memory cards, PCMCIA cards, smart cards, optical flash passes, digital audio disks, or other media which have not yet found widespread acceptance in the market.

While in the preferred embodiment, the label holder 28 is dimensioned for use with letter-sized paper, the holder may of course be dimensioned for other common sizes, such as A4 or Legal size sheets, for example, or for a 3"×5" index card, or other popular sized card stock.

As used herein, the terms "front", "back", "top", "side", "bottom", "inner" and "outer" and words of similar meaning are intended to apply to the relative positions depicted in the drawings, since in use the file system may of course be oriented in a number of positions.

Although the invention has been shown and described with respect to exemplary embodiments thereof, various other changes, additions and omissions in the form and detail thereof may be made therein without departing from the spirit and scope of the invention.

What is claimed is:

1. A portable filing system comprising:

a unitary cover, said cover being subdivided into portions comprising a front flap, a top, a back, a bottom and a front; said cover being constructed and arranged to provide an open-sided surrounding enclosure having an interior and an exterior;

a media holder mounted to said front portion of said cover;

an accordion file being mounted to an interior of the enclosure defined by said cover;

the file system having a first, closed configuration wherein said front flap is in overlying relationship with said front portion of said cover, and a second, open configuration where said front flap is elevated from said front portion of said closure;

a closure retainer for maintaining the file system in said first, closed configuration;

a label holder attached to an exterior surface of said front flap and said back portion of said cover so as to overlie said top portion of said cover, wherein said label holder is dimensioned to closely accommodate a half sheet of standard sized paper.

2. The file system of claim 1 wherein said closure is an elastic band.

3. The file system of claim 1, wherein said accordion file further comprises:

a pair of Z-fold members having a first end and a second end, said first and second ends being attached to interior surfaces of said front portion and said back portion of said cover, respectively, said Z-fold members being positioned one each at locations proximate the lateral edges of said front and back portions of said cover so as to define a substantially closed volume in said surrounding enclosure defined by said cover;

a plurality of dividers disposed in said substantially closed volume in spanning relationship between said pair of Z-fold members.

4. The file system of claim 3, wherein said dividers further comprise divider tabs.

5. The file system of claim 3, wherein said front portion of said cover further comprises tabs on the top edge of said front portion on opposite lateral sides thereof upon which said Z-fold members are in part mounted to on an interior surface thereof.

6. The file system of claim 1, wherein said standard sized paper is letter sized paper.

* * * * *